US008021186B2

(12) United States Patent
Wang

(10) Patent No.: US 8,021,186 B2
(45) Date of Patent: Sep. 20, 2011

(54) ELECTRICAL CONNECTOR WITH IMPROVED BOARD MOUNTING PEG

(75) Inventor: Wen-Fang Wang, ShenZhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 86 days.

(21) Appl. No.: 12/387,292

(22) Filed: Apr. 30, 2009

(65) Prior Publication Data

US 2009/0275222 A1 Nov. 5, 2009

(30) Foreign Application Priority Data

Apr. 30, 2008 (CN) ..... 2008 2 0035896 U

(51) Int. Cl.
*H01R 13/60* (2006.01)

(52) U.S. Cl. ..... 439/567

(58) Field of Classification Search ..... 439/82, 439/567

See application file for complete search history.

(56) References Cited

U.S. PATENT DOCUMENTS

| | | | | |
|---|---|---|---|---|
| 5,378,172 | A | 1/1995 | Roberts | |
| 5,980,314 | A | 11/1999 | Roberts | |
| D524,744 | S * | 7/2006 | Lai | D13/147 |
| 7,329,146 | B2 * | 2/2008 | Yang et al. | 439/570 |
| 7,361,060 | B2 * | 4/2008 | Russelburg | 439/660 |
| 2005/0003704 | A1 * | 1/2005 | Kasahara | 439/567 |

* cited by examiner

*Primary Examiner* — Tho D Ta
*Assistant Examiner* — Travis S Chambers
(74) *Attorney, Agent, or Firm* — Wei Te Chung; Andrew C. Cheng; Ming Chieh Chang

(57) ABSTRACT

An electrical connector (100) is adapted for mounting to a circuit substrate having a board-mounting face (12) and a mounting peg (13) projecting from said board-mounting face (12). Said mounting peg (13) is bifurcated and defines a pair of legs (136,137) separated by an axial slit (132). Protrusions 134 are formed on the inner wall of both legs (136,137) to limit the deflection so as to prevent said legs (136,137) from breakage.

1 Claim, 4 Drawing Sheets

ELECTRICAL CONNECTOR WITH IMPROVED BOARD MOUNTING PEG

BACKGROUND OF THE INVENTION

1. Field of the Invention

The present invention generally relates to an electrical connector, and more particularly, to an novel structure of a mounting peg or post for securing an electrical connector to a printed circuit board through a hole in the board.

2. Description of Related Art

It is known to provide electrical connectors with means for securing the connector to a printed circuit board. Often, the connector has a molded thermoplastic housing and boardlock means is formed integral therewith. A typical form of boardlock is a snap latch for securing a connector block or housing to the printed circuit board. The snap latch typically is a molded plastic peg which is bifurcated to define a pair of resilient legs having latching barbs or hooks thereon. The legs, during insertion through a hole in the printed circuit board from a first side of the board, deflect inwardly toward the axis of the snap latch. As the hooks on the ends of the legs pass through the hole in the board, the legs bounce back outwardly into a position with shoulders on the hooks extending beyond the periphery of the hole and engaging a second side of the board, thereby securing the connector to the board. The pegs usually are an integral part of the connector housing or, in some instances, separate metal snap latches have been used.

U.S. Pat. No. 5,378,172 issued to Roberts on Jan. 3, 1995 just discloses such kind of snap latch boardlock. As the legs pass through the hole in the board, the legs snap back outwardly into a position with shoulders on the hooks extending beyond the periphery of the hole and engaging a second side of the board, thereby securing the connector to the board. However, the legs will encounter a deformation while passing through the hole in the board, after bending over some extent in the space between two legs, the problem of breakage is particularly prevalent with the brittle plastic material which presently is used quite often in molding connector housings.

Hence, the present invention is directed to solving this problem in a typical bifurcated mounting peg by limiting the deflection required to install or uninstall the peg into the hole in the circuit board.

SUMMARY OF THE INVENTION

An object, therefore, of the invention is to provide a new and improved electrical connector of the character described above, with a novel mounting peg structure.

In order to achieve the object set forth, an electrical connector is adapted for mounting to a circuit substrate having a board-mounting face and a mounting peg projecting from said board-mounting face. Said mounting peg is bifurcated and defines a pair of legs separated by an axial slit. Protrusions are formed on the inner wall of both legs to limit the deflection so as to prevent said legs from breakage.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
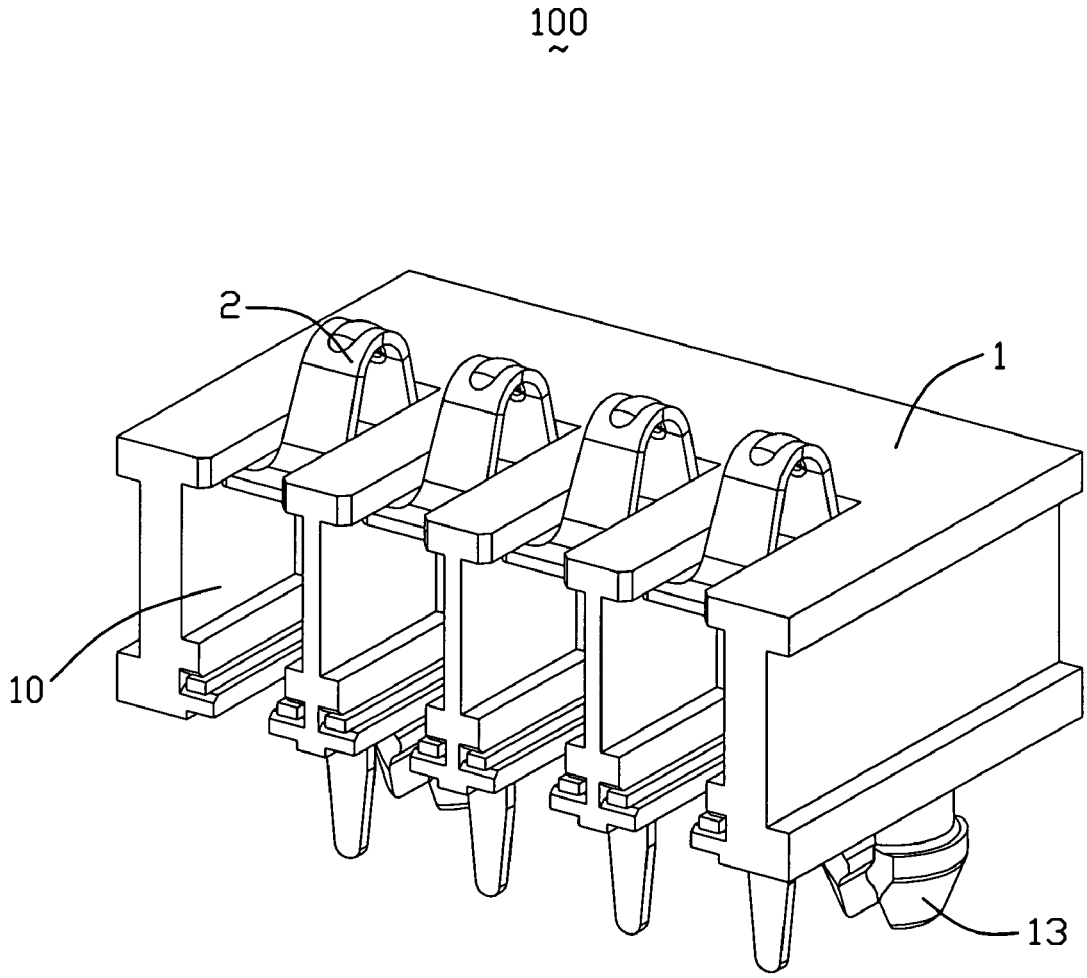
FIG. 1 is an assembled, perspective view of the electrical connector of an embodiment of the present invention.
Figure 2:
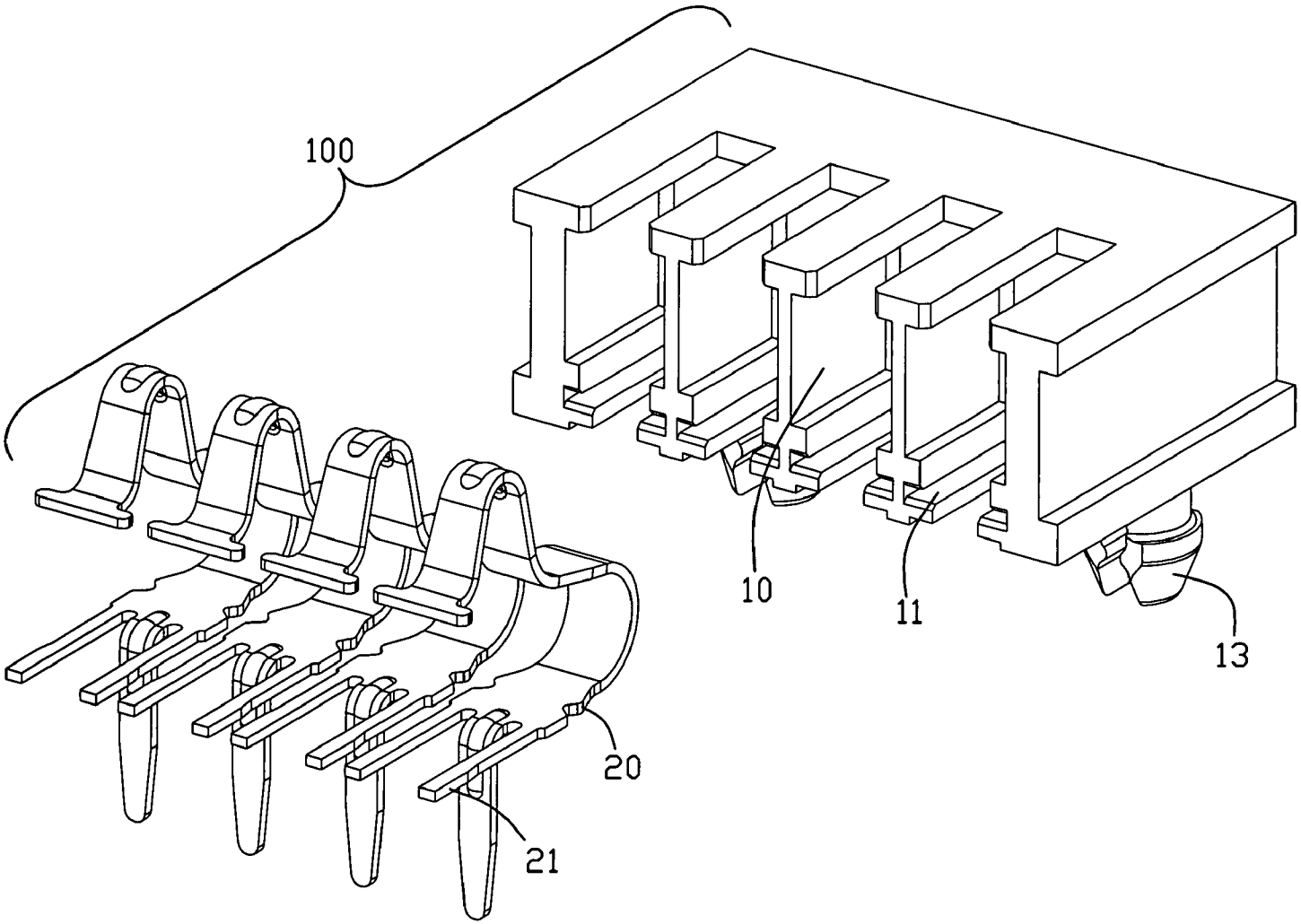
FIG. 2 is an exploded, perspective view of the electrical connector as shown in FIG. 1.

Referring to FIGS. 1-2, an electrical connector 100 for mounting on a circuit substrate (not shown) in accordance with the embodiment of the present invention comprises a dielectric housing 1 with a number of parallel terminal passages (10,11) extending to an exterior in both vertical and horizontal directions, and a plurality of terminals 2 with fixing portion (20,21) received in said terminal passages (10,11) and deflectably moving within the terminal passages (10,11) with corresponding contact sections (not labeled) extending out of a front face of the housing 1.

Figure 3:
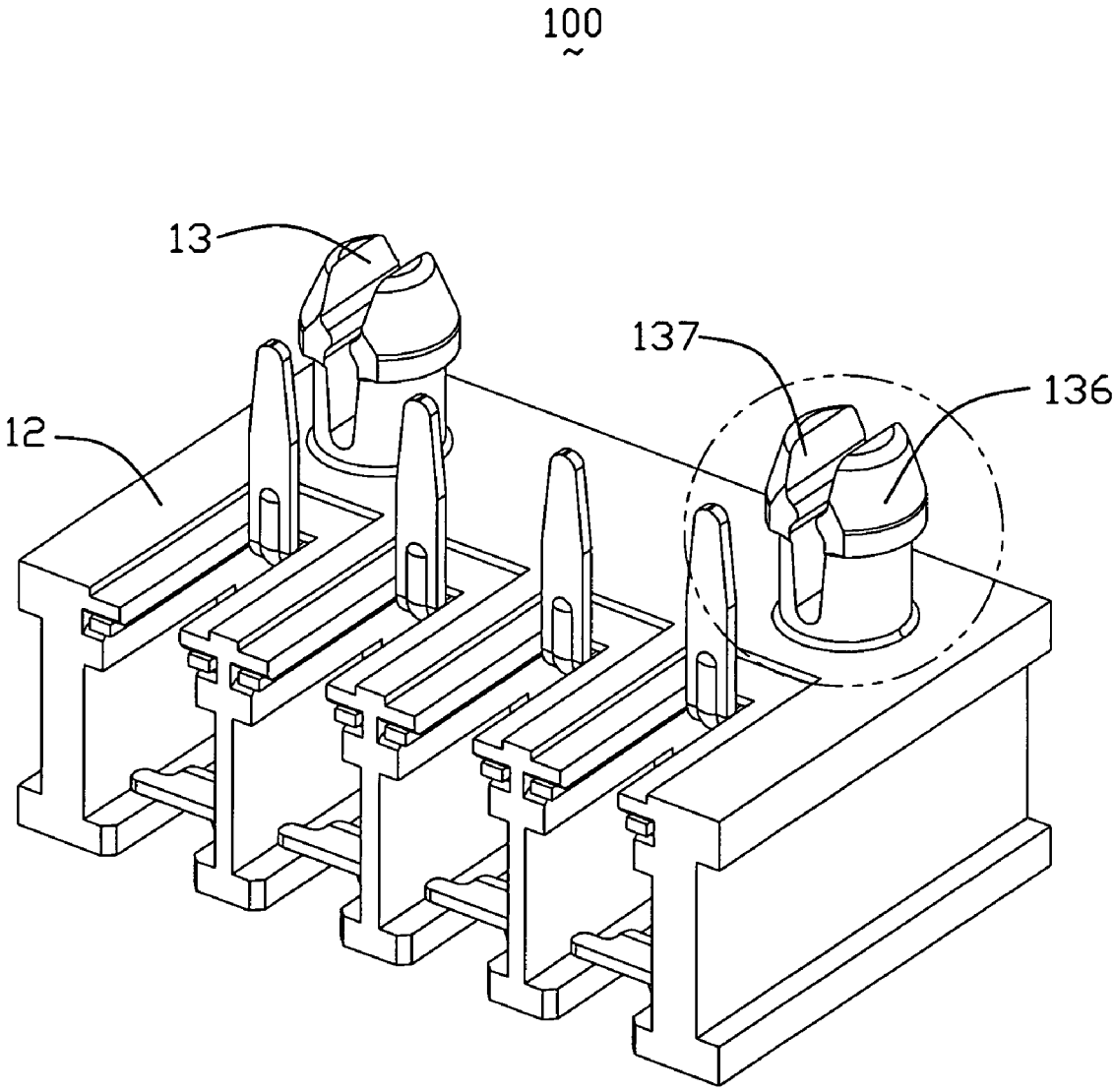
FIG. 3 is another perspective view of the electrical connector as shown in FIG. 1.
Figure 4:
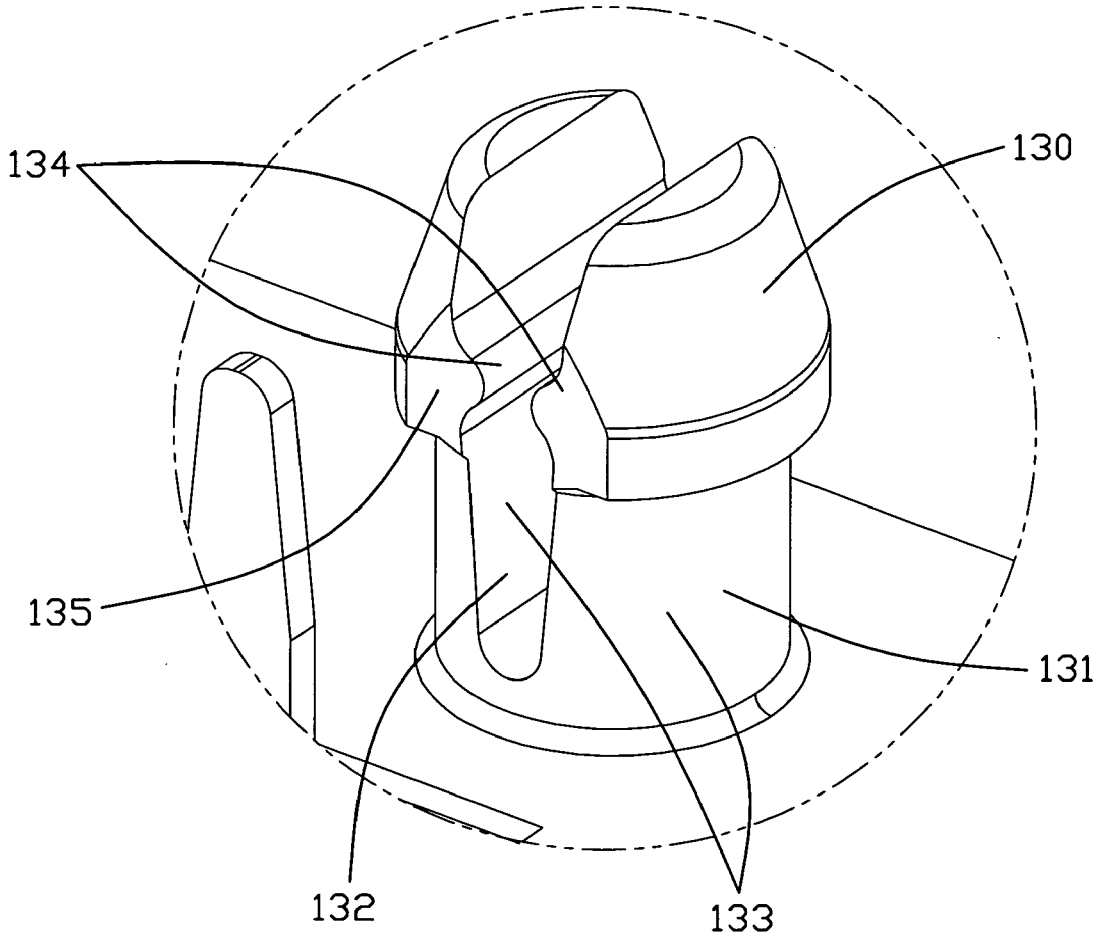
FIG. 4 is an enlarged, perspective view of the mounting peg as shown in FIG. 3.

Referring to FIGS. 3-4, the dielectric housing 1 further comprises a board-mounting face 12 and two mounting pegs 13 projected from said board-mounting face 12. Each of said mounting pegs 13 is bifurcated and defines a pair of legs (136,137) separated by an axial slit 132, which makes the legs (136,137) flexible under deformation. As shown in FIGS. 1-2, each terminal has three bifurcations 21 on one end, the middle bifurcation is perpendicular to the board-mounting face 12 as a mounting part and the two side bifurcations 21 are parallel to the board-mounting face 12 to engage with two retaining slots on opposite inside faces of each passageway.

Referring to FIG. 4, each mounting peg 13 comprises a cylindrical portion 131 and a cone-shaped mounting portion 130 united by the free end of said legs (136,137). Said cone-shaped mounting portion 130 has a maximum diameter, which makes the joint of the cylindrical portion 131 and the cone-shaped mounting portion 130 forms a latching barb (not labeled) to extend beyond the periphery of the hole (not shown) and secure the connector 100 to the second side of the board (not shown).

Still referring to FIG. 4, said axial slit 132 is essentially coincident with the central axis of the mounting peg 13 and is formed in a V-shaped configuration and is symmetrical to the central axis of the mounting peg 13 so as to make better flexibility of both legs (136,137). Protrusions 134 as a continuous rib parallel to said terminal passages 10 are formed on the axial slit 132 respectively to the maximum diameter of the mounting peg 13. When the pegs 13 are pushed through the holes of the printed circuit board to mount the connector thereon, the inner surface of the legs (136,137) will abut against each other so as to prevent the legs (136,137) from over-stretching thereby advantageously avoiding the breakage of the legs (136,137).

It should be noted that, in this embodiment, the axial slit 132 is essentially coincident with the central axis (not labeled) of the mounting peg 13 and the protrusions 134 are set on both legs (136,137). In some other embodiments, axial slit 132 can also be deflected from the central axis of the mounting peg 13 and either of the legs (136,137) has protrusion 134 will remain available.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative housing defining a mounting face;

a mounting peg unitarily downwardly extending from the mounting face, said mounting peg including an upper portion and a bottom portion with an enlarged cone like head around a bottom portion thereof and an upside-down V-like slot extending through both said upper portion and said bottom portion to bifurcate the mounting peg into a pair of legs with a pair of interior surfaces facing to each other; and a pair of ribs formed on said interior surfaces, respectively, and located around a level where said peg defines a maximum diameter thereof; wherein each of said ribs extends horizontally with a full transverse extent of the corresponding leg at said level.

* * * * *